US006441706B1

(12) United States Patent
Nelson

(10) Patent No.: US 6,441,706 B1
(45) Date of Patent: Aug. 27, 2002

(54) SEAL FOR AN RF CONNECTOR

(75) Inventor: James W. Nelson, Cheshire, CT (US)

(73) Assignee: Radio Frequency Systems, Inc., Washington, DC (US)

( * ) Notice: Subject to any disclaimer, the term of this patent is extended or adjusted under 35 U.S.C. 154(b) by 8 days.

(21) Appl. No.: 09/734,757

(22) Filed: Dec. 13, 2000

(51) Int. Cl.[7] ..... H01P 1/02

(52) U.S. Cl. ..... 333/260; 439/578; 439/248; 174/99 E

(58) Field of Search ..... 333/260; 439/578, 439/248; 174/99 E

(56) References Cited

U.S. PATENT DOCUMENTS

| | | | | |
|---|---|---|---|---|
| 249,284 | A | 11/1881 | Woodward | 174/71 R |
| 1,859,390 | A | 1/1932 | Green | 174/28 |
| 3,055,967 | A | 9/1962 | Bondon | 174/28 |
| 3,349,167 | A | 10/1967 | Mixon et al. | 174/94 R |
| 3,356,785 | A | 12/1967 | Yoshida et al. | 174/28 |
| 4,145,565 | A | 3/1979 | Donon | 174/28 |
| 4,194,750 | A | 3/1980 | Sovish et al. | 277/615 |
| 4,452,503 | A | 6/1984 | Forney, Jr. | |
| 4,596,434 | A | 6/1986 | Saba et al. | |
| 4,700,159 | A | 10/1987 | Jones, III | 333/244 |
| 5,167,532 | A | 12/1992 | Bruno et al. | 439/578 |
| 5,451,717 | A | 9/1995 | Itou | 174/77 R |
| 5,790,002 | A | 8/1998 | Fischer et al. | 333/244 |
| 5,790,003 | A | 8/1998 | Fischer et al. | 333/244 |
| 5,854,444 | A | 12/1998 | Fehlhaber | 174/84 R |
| 5,938,474 | A * | 8/1999 | Nelson | 439/578 |

FOREIGN PATENT DOCUMENTS

| | | |
|---|---|---|
| WO | WO 93/24973 | 12/1993 |

* cited by examiner

*Primary Examiner*—Benny Lee
*Assistant Examiner*—Wesley Harris
(74) *Attorney, Agent, or Firm*—Sughrue Mion, PLLC

(57) ABSTRACT

An RF connector of a coaxial cable having an inner conductor, an outer conductor surrounding the inner conductor, a dielectric cylinder located between the inner and outer conductors, an outer radial barb projecting radially inwardly from the outer conductor into the cylinder, and an axial barb projecting axially from the outer conductor into the cylinder. The outer radial barb and axial barb work in cooperation to decrease the effect of contraction in the dielectric cylinder during colder temperatures, thereby providing a seal which prevents water and moisture from entering the connector.

19 Claims, 1 Drawing Sheet

SEAL FOR AN RF CONNECTOR

BACKGROUND OF THE INVENTION

1. Field of the Invention

The present invention relates generally to a watertight RF connector of a coaxial cable, and more particularly to a watertight RF connector having an axial barb seal.

2. Description of the Related Art

A coaxial cable, which is used to transmit radio frequency (RF) signals, is a cylindrical transmission line made up of an inner conductor and a tube-shaped outer conductor separated by a dielectric spacer. Coaxial cables are connected or terminated using an RF connector. The RF connector has an inner conductor and tube-shaped outer conductor, which connect to the respective conductors of the cable.

It is sometimes required to place coaxial cables and RF connectors outdoors. The RF connectors must therefore be adequately weatherproofed so as to prevent water and moisture due to rain and humidity from entering the connector bodies and adversely affecting the components, within the connectors and cables.

Most conventional RF connectors rely on a mating interface connector to prevent moisture ingress. An improved connector will use O-rings to seal the interface between the dielectric spacer and outer conductor of the connector. This will prevent moisture ingress along the axis of connector. Although the moisture seal provided by the O-ring is effective, the O-ring is an additional component resulting in a more complex and costly assembly.

Attempts have therefore been made to eliminate the O-ring from the construction of the connector by providing ring-shaped radial barbs that project from the conductors and press fit into the spacer. However, radial barbs alone are not sufficient to provide a reliable moisture seal over a wide enough temperature range. That is, most dielectric materials (e.g., Teflon) suitable for manufacturing spacers of RF connectors have a larger coefficient of expansion than the conductive material (e.g., brass) used to form the outer conductor portion of the connector. At colder temperatures the spacer therefore shrinks away from the outer conductor, thereby compromising the intended seal between the outer conductor and the spacer.

SUMMARY OF THE INVENTION

It is an object of the present invention to effectively seal an RF connector from water and moisture without the use of an O-ring.

This object is fulfilled by providing a connector with a combination of an outer radial barb projecting radially inwardly and an axial barb projecting axially from the outer conductor into the dielectric cylinder. When the dielectric cylinder attempts to shrink away from the outer conductor during colder temperatures, the outer radial and axial barbs work in cooperation to oppose the force of thermal contraction of the cylinder to thereby ensure that the moisture seal of the connector is maintained.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENTS

Figure 1:
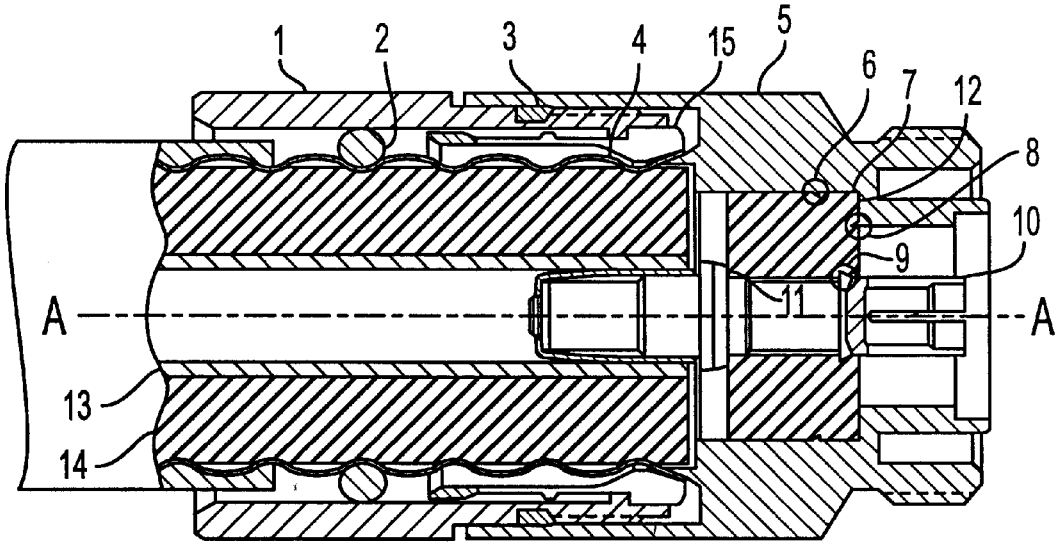
FIG. 1 illustrates a longitudinal cross sectional view of an RF cable and connector having a barb seal according to the present invention.
Figure 2:
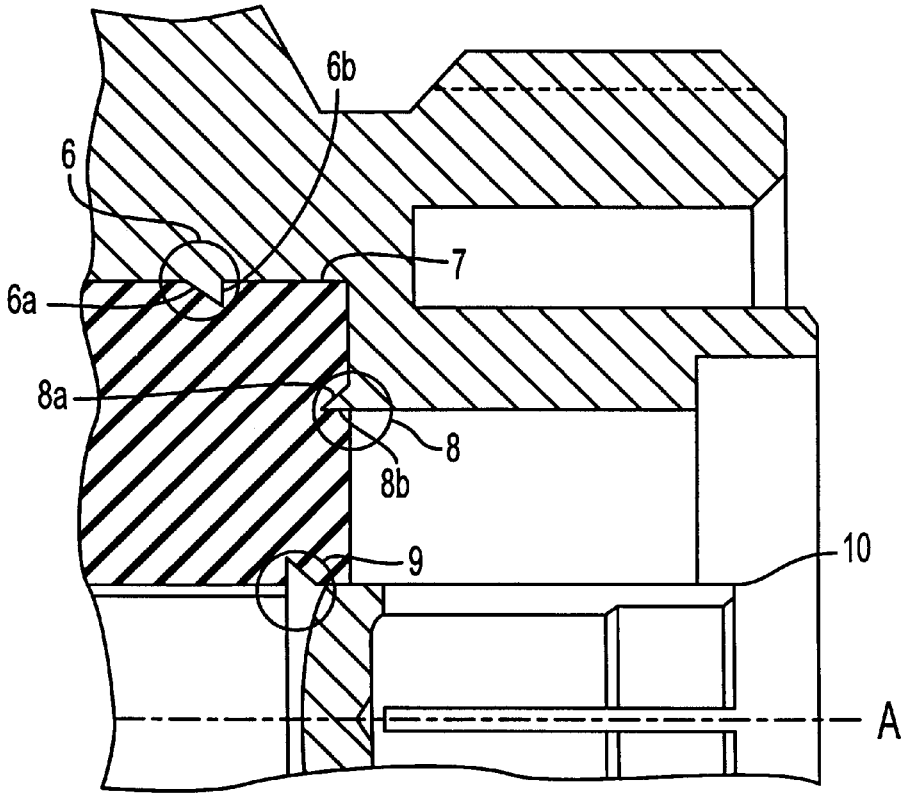
FIG. 2 illustrates an exploded view of the barb seal of the connector of FIG. 1.

FIG. 1 illustrates an RF cable and connector having a barb seal according to the present invention, and FIG. 2 illustrates an exploded view of the barb seal shown in FIG.

The cable, shown in the left-hand side of FIG. 1, has a hollow inner conductor 13 concentrically spaced from center line A—A, an outer conductor 4 disposed about the inner conductor 13 and concentrically spaced from center line A—A. The space between the cable inner conductor 13 and the cable outer conductor 4 is filled by a dielectric spacer 14.

The connector, shown in the right-hand side of FIG. 1, has an inner conductor 10 concentrically spaced from center line A—A, and a connector body or an outer conductor 5 disposed about the inner conductor 10 and concentrically spaced from center line A—A. A dielectric cylinder 7 having an axial opening therethrough is disposed over the connector inner conductor 10 for the purpose of maintaining the connector inner conductor 10 in the proper location with respect to the connector outer conductor 5. The dielectric cylinder 7 may be press-fit onto the connector inner conductor 10. An inner radial barb 9 and shoulders 11 and 12 of the connector inner conductor 10 and the connector outer conductor 5, respectively, prevent the inner conductor 10 from moving axially with respect to the dielectric cylinder 7 disposed thereover. Preferably, both connector conductors 10 and 5 are made of brass, and the dielectric cylinder 7 is preferably made of Teflon.

Attachment of the connector to the cable is accomplished by attaching the outer conductor 5 of the connector with a backnut 1 and collet 15, which is secured to the jacket of the cable. An O-ring seal 3 is positioned between the backnut 1 and the outer conductor 5 to seal out moisture, dirt and other contaminants. Similarly, an O-ring seal 2 is positioned between the backnut 1 and the outer conductor 4 of the cable.

The barb sealing arrangement of the present invention for sealing the outer conductor 5 of the connector with the dielectric cylinder 7 will now be described with reference to FIG. 2. A ring-shaped outer radial barb 6 projects radially inwardly from the connector outer conductor 5 and penetrates the dielectric cylinder 7. Also, a ring-shaped axial barb 8 projects axially from the stepped surface of the shoulder 12 of the outer conductor 5 to penetrate the dielectric cylinder 7. Each of these barbs is shaped like a right triangle, with the base of the triangle lying along the conductor and a point of the triangle projecting into the dielectric cylinder 7, as shown in FIG. 2. The sides of the triangle forming the projection of the outer radial barb 6 are the inclined surface 6*a* and the vertical surface 6*b*. According to the preferred embodiment, the vertical surface 6*b* of the outer radial barb is parallel to the step surface of the shoulder 12, as shown in FIG. 2. Similarly, the sides of the triangle forming the projection of the axial barb 8 are the outwardly facing inclined surface 8*a* and the surface 8*b*. This right triangle shape allows for easy penetration of the barbs into the dielectric cylinder 7.

However, the invention is not limited in this respect. For example, the outer radial barb 6 could be designed so that the surface 6*b* forms an acute angle with the surface of the outer conductor, so that the barb penetrates the dielectric cylinder more easily.

During colder temperatures the dielectric cylinder 7 tends to shrink radially away from the outer conductor 5. The dielectric cylinder 7 as it shrinks presses against the axial barb 8. The inclined surface 8*a* of the axial barb 8 pushes the dielectric cylinder 7 back against the vertical surface 6*b* of the outer radial barb 6. Thus, when the dielectric cylinder 7 shrinks, it is urged against the inclined surface 8*a* of the axial barb 8 and the vertical surface 6*b* of the outer radial barb 6, both of which circumscribe the connector. Therefore, these two surfaces act to seal the connector to the dielectric cylinder 7. Accordingly, even though the shrunk dielectric cylinder 7 may not contact the inner surface of the outer conductor, sealing is still achieved by the inclined surface 8*a* of the axial barb 8 and the vertical surface 6*b* of the radial barb 6.

To achieve this effect, the outer radial barb 6 should be placed in close proximity to the axial barb 8. If the distance between the outer radial barb 6 and the axial barb 8 is too great, the dielectric cylinder 7 will shrink away from both barbs. In addition to sealing the dielectric cylinder 7, the outer radial barb 6 also prevents the cylinder 7 from moving in the axial direction, similar to the inner radial barb 9, discussed above.

The shape and orientation of the axial barb 8 and outer radial barb 6 are important in providing a good seal as temperature varies. In a preferred embodiment the outer radial barb 6 and axial barb 8 are each shaped like a right triangle as described above. However, the shape and orientation of the radial barb 6 and axial barb 8 are not limited, but can instead be adjusted to compensate for the axial shrinkage of the dielectric cylinder 7.

The sizes of the barbs in the figures are enlarged for the sake of clarity. Preferably, the height of the barbs should be greater than the amount of radial shrinkage of the dielectric cylinder 7. For example, in a typical environment, a Teflon cylinder 7 may shrink 0.003 inches in the radial direction. In this case, the barb height should be greater than 0.003 inches, and preferably in the range of 0.008 to 0.012 inches.

Although the invention has been described with reference to specific embodiments, this description is not meant to be construed in a limiting sense. Various modifications of the disclosed embodiments, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An RF connector for a coaxial cable comprising:

an inner conductor;

an outer conductor surrounding the inner conductor;

a dielectric spacer located between the inner and outer conductors;

an outer radial barb projecting radially inwardly from the outer conductor into the spacer; and an axial barb projecting axially from the outer conductor into the spacer.

2. The RF connector of claim 1, wherein the axial barb has a right triangle shape.

3. The RF connector of claim 1, wherein the outer radial barb has a right triangle shape.

4. The RF connector of claim 1, further comprising an inner radial barb projecting radially outwardly from the inner conductor into the spacer.

5. The RF connector of claim 4, wherein the inner radial barb has a right triangle shape.

6. The RF connector of claim 1, wherein the outer conductor has a shoulder from which the axial barb projects.

7. The RF connector of claim 1, wherein the height of at least one of the outer radial barb and axial barb is in a range of 0.008 to 0.012 inches.

8. The RF connector of claim 1, wherein an inclined surface of the axial barb faces outwardly.

9. The RF connector of claim 1, wherein an inclined surface of the axial barb faces the outer radial barb.

10. The RF connector of claim 1, wherein the outer conductor has a shoulder portion defining a step surface on which the axial barb is located, and a vertical surface of the outer radial barb is parallel to the step surface of the shoulder portion.

11. The RF connector of claim 10, wherein the axial barb has an inclined surface which faces outwardly.

12. The RF connector of claim 11, wherein the inclined surface of said axial barb is inclined with respect to said step surface.

13. The RF connector of claim 10, wherein the vertical surface of the outer radial barb faces said step surface.

14. The RF connector of claim 13, wherein the axial barb has an inclined surface which faces outwardly.

15. The RF connector of claim 13, wherein the inclined surface of said axial barb is inclined with respect to said step surface.

16. The RF connector of claim 1, wherein the outer radial barb and the axial barb are integral to the outer conductor.

17. The RF connector of claim 1, wherein the outer radial barb and the axial barb are unitary with the outer conductor.

18. The RF connector of claim 1, wherein the inner and outer conductors are independent of the coaxial cable.

19. The RF connector of claim 1, wherein the outer conductor is electrically connectable to an outer conducting member of the coaxial cable and wherein the inner conductor is electrically connectable to an inner conductor member of the coaxial cable.

* * * * *